United States Patent [19]

Pelletier

[11] 4,030,679

[45] June 21, 1977

[54] STAND FOR A ROLL OF FLOOR COVERING MATERIAL

[76] Inventor: Herve Joseph Pelletier, Middlesex Road, Topsham, Maine 04086

[22] Filed: Apr. 2, 1976

[21] Appl. No.: 672,863

[52] U.S. Cl. ..... 242/68

[51] Int. Cl.[2] ..... B65H 17/02

[58] Field of Search ..... 242/54 R, 55.2, 129.5, 242/129.6, 129.62

[56] References Cited

UNITED STATES PATENTS

| | | | |
|---|---|---|---|
| 2,601,960 | 7/1952 | Hick | 242/129.6 |
| 3,069,110 | 12/1962 | Domer | 242/129.6 |
| 3,120,358 | 2/1964 | Ensley | 242/129.6 |

*Primary Examiner*—Leonard D. Christian

[57] ABSTRACT

A stand for a roll of a floor covering material has two supports, each provided with a receiver for an end of the core of the roll and located to hold a roll of a predetermined maximum diameter above the floor and a vertical lever portion. When the two stands are spaced apart to accommodate a roll, each stand may be tipped to permit an end of the roll core to enter or be entered into its receiver with the roll resting on the floor and then erected by means of its lever portion with an end of its base serving as a fulcrum.

6 Claims, 6 Drawing Figures

STAND FOR A ROLL OF FLOOR COVERING MATERIAL

BACKGROUND REFERENCES

U.S. Pat. Nos. 968,476; 1,403,692; 2,666,595; 2,838,249.

BACKGROUND OF THE INVENTION

Floor covering materials such as linoleum and carpet materials are delivered to the retailer in rolls that may weigh as much as five hundred pounds and in order that desired lengths may be sold, the rolls are rotatably supported so that the material can be pulled therefrom to enable it to be measured and the desired length cut free.

In many stores, racks are used to support a plurality of such rolls as a vertical series. To that end, the racks have upwardly opening receivers provided with anti-friction inserts for the support of the exposed ends of the roll cores. It will be appreciated that while such rolls can be rolled from one place to another, lifting them onto a stand is another matter and in the case of racks, hoisting means are necessary because of the height at which the upper roll or rolls are to be supported.

THE PRESENT INVENTION

The general objective of the present invention is to provide a stand consisting of a pair of supports enabling one person to transfer a roll of floor covering materials of a predetermined maximum diameter from the floor to a position in which that roll may be rotated in winding or unwinding directions, an objective attained with each support including a floor engaging base, an upright having an upwardly opening receiver for a core end, and a vertical lever portion.

When a support is tilted with only one end of the base resting on the floor, relative movement between the roll and the support enables a core end to be entered into the receiver of that support. Because of the mechanical advantage the lever portion then affords, a single person can readily erect the thus positioned support. The receiver is so located that the proximate end of that roll, if its diameter does not exceed a predetermined maximum, is then spaced from the floor but the roll is not free to turn until the other end of the core is similarly entered into the other support in the same manner and that support is also erected.

Another objective of the invention is to ensure stability of the roll stand in use without requiring that the supports be of a relatively heavy construction, an objective attained by providing that the base of each support includes a first portion of substantial length relative to which the receiver is centrally located and a second portion extending laterally away from the side of the stand that is to be proximate to the roll.

Other objectives of the invention are concerned with structural features and will be apparent from the specification and appended claims.

BRIEF DESCRIPTION OF THE DRAWINGS

A preferred embodiment of the invention is illustrated by the accompanying drawings

THE PREFERRED EMBODIMENT OF THE INVENTION

Figure 1:
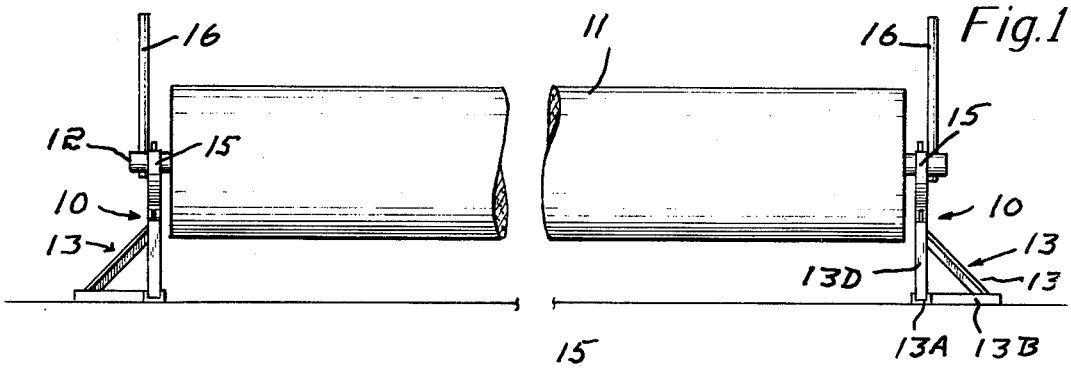
FIG. 1 is a front elevation of a stand in accordance with the invention.
Figure 2:
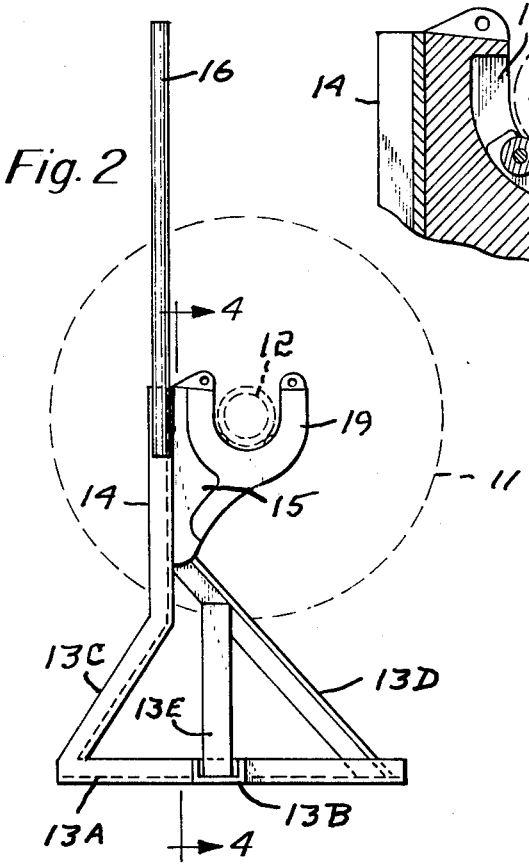
FIG. 2 is an end view thereof on a substantial increase in scale.

The roll stand illustrated by the drawings consists of a pair of supports, each generally indicated at 10, for use in holding a roll 11 of floor covering material by the exposed ends of its core 12 so that it can be rotated to permit the material to be disposed in a desired length or to permit material to be wound thereon. Such materials as linoleum and carpet materials come from the factory in relatively heavy rolls, some such rolls weighing as much as 500 pounds.

Each roll support has a base, generally indicated at 13, an upright 14 of stock that is U-shaped in cross section and provided with an upwardly opening receiver 15 for a core end located above the central part of the base 13 and welded to the upright 14, as is a vertically extending lever 16.

The base 13 is shown as including a bottom section 13A of stock that is U-shaped in cross section and having a like section 13B welded to one of its sides between the ends thereof and in the same plane, the floor engaging part of the base thus being T-shaped. At each end of the bottom section 13A there is a section upwardly inclined towards the other, the section 13C shown as an integral part of the upright 14 and locating the receiver 15 so that the axis of a supported roll 11 will be about midway between the ends of the base section 13A and close to the junction of the base section 13B therewith and the section 13D of stock that is right angular in cross section and welded to the receiver 15 and to the section 13A. The base 13 is completed by a brace 13E welded to the outer end of the section 13B and to the section 13D adjacent its upper end.

Figure 5:
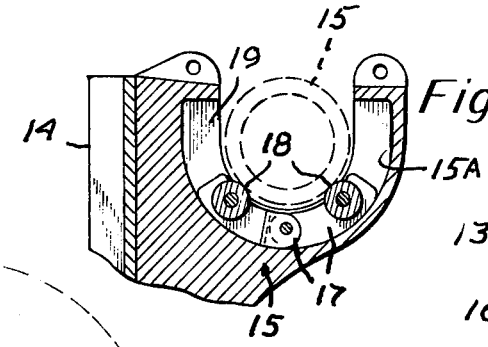
FIG. 5 is a section on the scale of FIG. 4, taken approximately along the indicated line 5—5 of FIG. 3.
Figure 3:
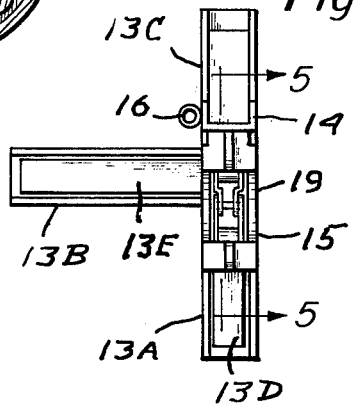
FIG. 3 is a top plan view of one of the two supports of the stand.
Figure 4:
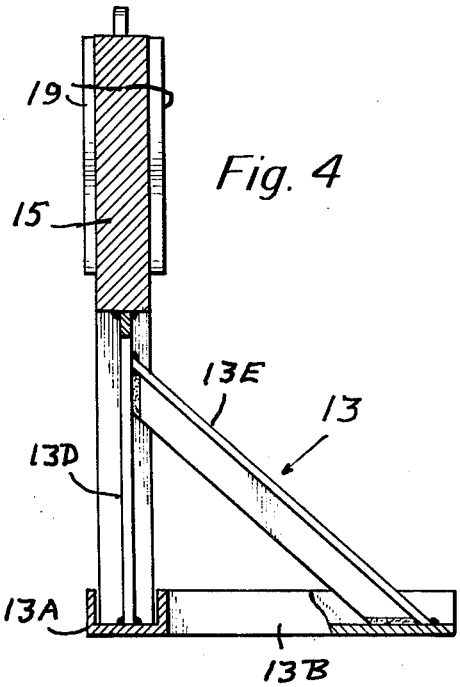
FIG. 4 is a section, on a further increase in scale, taken approximately along the indicated line 4—4 of FIG. 2.
Figure 6:
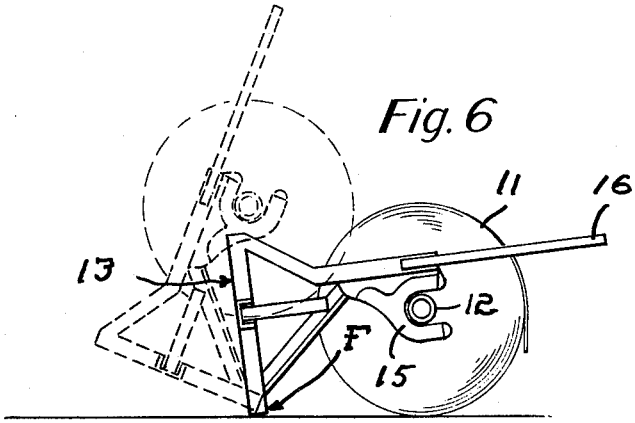
FIG. 6 is an end view of the stand with one of its twin supports positioned with an end of the core of a roll within its receiver.

In practice, the receiver 15 is of a commercially available type with which racks, not shown, are provided, the racks typically supporting a plurality of rolls 11 as a vertically spaced series. Such receivers include a U-shaped holder 15A in support of a pair of links 17 each having a roller 18 protruding from its upper edge and spaced above its bottom edge, see FIG. 5, and the links 17 are confined by retainers 19.

The supports 10 are for use with rolls of a predetermined maximum radius and each receiver 15 is located so that such a roll may be supported above the floor and each lever 16 is of a length to extend well above the thus supported roll.

When a roll 11 is to be positioned in the stand by one person, one support 10 is tilted so that one end of the bottom section 13A is in contact with the floor, in practice the end F thereof. With the roll 11 resting on the floor, the roll either may be rolled to bring an end of its core 12 into the receiver 15 of that support or that support may be pulled into a position seating that core end in its receiver 15. That support 10 is then easily erected by means of the lever 16 because of the available leverage it affords. The operation is then repeated with the other support 10 at the other end of the roll 11. It should be noted that the bottom sections 13B of the two supports are disposed away from the roll 11.

With a roll 11 thus supported, material may be wound onto a rack-supported roll, unwound and a desired length cut therefrom, or a desired length wound thereon from a rack-supported roll.

I claim:

1. A stand for a roll of a floor covering material having a maximum outside diameter and provided with a core having protruding ends, said stand comprising a pair of supports, each support including a floor engaging base and an upright provided with an upwardly opening U-shaped receiver for an end of said core and located a distance above said base greater than the maximum radius of the roll, at least one end of said base being useable as a fulcrum, and each upright support also including a lever portion extending vertically relative to said base beyond said receiver a distance greater than said maximum radius and at one side of the receiver whereby said supports may have spaced apart loading positions in which each base is supported by its fulcrum end with its receiver in a position such that on relative movement between that support and the roll, the core ends enter the receivers with the roll on the floor, the lever portions then enabling the supports to be erected with the cross rods seated in the receivers.

2. The stand of claim 1 in which the floor engaging portion of each support is substantially T-shaped, the portion that is the head of the T extending at right angles to the axis defined by the receiver.

3. The stand of claim 2 in which the other portion of the stand extends away from the position to be occupied by the supported roll and the base includes a brace for said other portion.

4. The stand of claim 3 in which the floor engaging portions of the base are sections of U-shaped stock the channels of which open upwardly, the base includes end portions inclined towards each other, one connected to the upright and the other connected to the receiver, and the brace is connected to said other end portion.

5. The stand of claim 4 in which said one end member and the upright are both U-shaped.

6. The stand of claim 1 in which the receiver is on the side of the upright that is proximate to the fulcrum end of the base.

* * * * *